US005226062A

United States Patent [19]

Fluharty

[11] Patent Number: 5,226,062

[45] Date of Patent: Jul. 6, 1993

[54] METHOD AND DEVICE FOR DETECTING MULTI-LEVEL DIGITAL SIGNAL DATA STREAM TERMINATION

[75] Inventor: Kevin L. Fluharty, Elgin, Ill.

[73] Assignee: Motorola, Inc., Schaumburg, Ill.

[21] Appl. No.: 647,089

[22] Filed: Jan. 29, 1991

[51] Int. Cl.[5] ..... H04L 27/06

[52] U.S. Cl. ..... 375/96; 375/17; 364/715.11

[58] Field of Search ..... 375/17, 20, 94, 96, 375/102, 121; 364/715.11

[56] References Cited

U.S. PATENT DOCUMENTS 4,928,288 5/1990 D'Aria et al. ..... 375/17

4,972,441 11/1990 Roberts et al. ..... 375/96

*Primary Examiner*—Curtis Kuntz

*Assistant Examiner*—Young Tse

*Attorney, Agent, or Firm*—Darleen J. Stockley

[57] ABSTRACT

A multi-level digital signal data stream termination detector is set forth that utilizes detection of multiple relatively short detection patterns separated by a time less than a predetermined allowable time to detect digital data stream termination even in the presence of simulcast distortion.

28 Claims, 3 Drawing Sheets

100

FIG. 2A 200
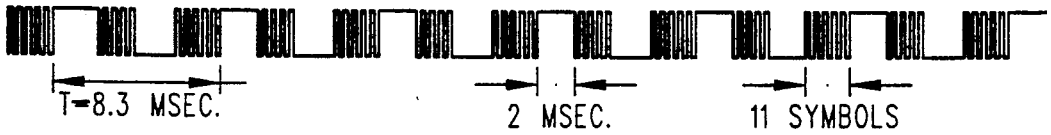
FIG. 2B 210
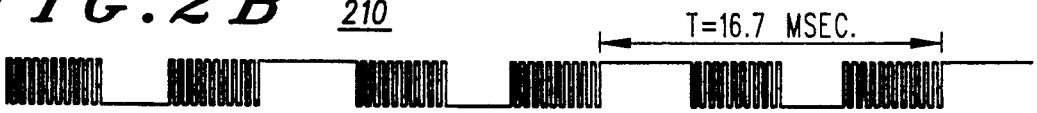
FIG. 2C 220
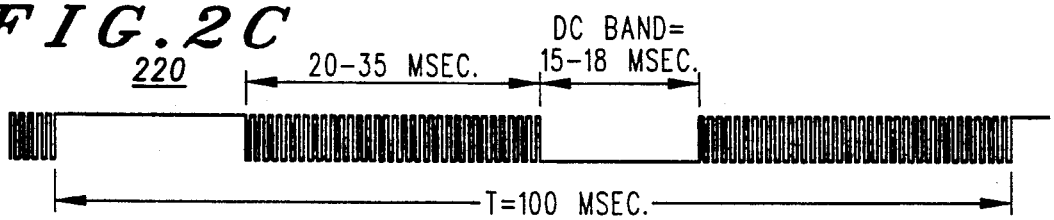
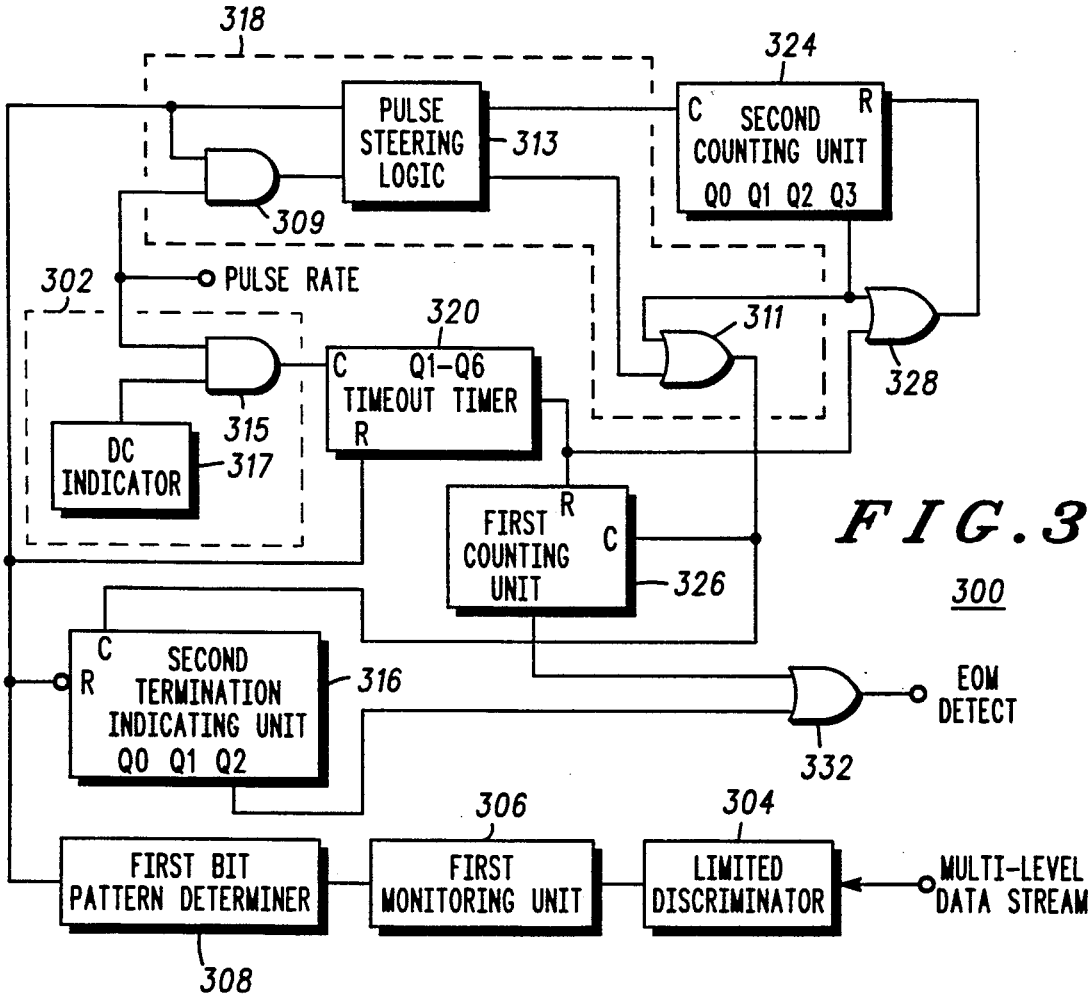
FIG. 3

METHOD AND DEVICE FOR DETECTING MULTI-LEVEL DIGITAL SIGNAL DATA STREAM TERMINATION

FIELD OF THE INVENTION

This invention relates to multilevel digital signal decoding systems, and more particularly to multi-level digital signal data stream termination detecting devices and methods.

BACKGROUND OF THE INVENTION

Pulse-code modulation (PCM) systems typically utilize transmission of digitized signals of quantized and coded information. Quantization is generally achieved by selecting a number of discrete pulse amplitude levels. Quantization may be linear, by utilizing uniformly spaced levels, or nonlinear, by utilizing nonuniformly spaced levels. Digitization provides for one-to-one correspondence between each level and a set of real integers, typically digits expressed in a coded, often binary, form. For example, a system quantized to eight levels could be binary coded 000, 001, 010, 011, 100, 101, 110, and 111, each binary code representing a pulse code data stream of 1's and 0's for a next higher level. Each pulsed waveform is thus effectively reduced to a set of digits at successive sample times. Instead of transmitting individual samples at selected sample times, a pulse code is sent at the selected sample times, thereby providing information in quantized form.

In simulcast PCM communication systems differential delays and Doppler shifts often cause distortion of received signals, thereby also making determination of termination of multi-level digital signal data streams difficult. Data stream termination detectors that rely on a single sampling interval have been described in the prior art. Such detectors, however, where sampling is started too late into a sample interval to permit a correlator from amassing enough correlation occurrences, may discard vital termination information, thereby failing to provide accurate termination information. There is a need for an improved device and method for determining the termination of multi-level digital signal data streams.

SUMMARY OF THE INVENTION

A device and method are set forth for substantially detecting termination of at least a first received multi-level digital signal data stream, the device comprising at least:

a synchronous sequential symbol determiner, responsive to the at least received first multi-level digital signal data stream, for determining at least a first plurality of detected bits in view of the at least first multi-level digital signal data stream; a first monitoring unit, responsive to the synchronous sequential symbol determiner, for utilizing at least the first plurality of detected bits to determine at least a substantially uninterrupted primary predetermined first bit length group for each desired plurality of detected bits having at least a predetermined first bit length, and as desired, to determine at least a first window-shifted substantially uninterrupted second predetermined first bit length group for each desired plurality of consecutive detected bits having at least a predetermined first bit length; a first bit pattern determiner, responsive to the first monitoring unit, for determining at least whether or not each substantially uninterrupted predetermined first bit length group of the plurality of bits having at least the predetermined first bit length has a bit pattern that substantially corresponds to a first predetermined bit pattern of the multi-level digital signal data stream; a second monitoring unit, responsive to the first bit pattern determiner, for determining whether each substantially uninterrupted predetermined first bit length group of the detected plurality of bits having at least the predetermined first bit length and a bit pattern substantially corresponding to the first predetermined bit pattern of the multi-level digital signal data stream is one of:

the substantially uninterrupted primary predetermined first bit length group; and the window-shifted substantially uninterrupted at least second predetermined first bit length group; a first counting unit, responsive to the second monitoring unit and to at least a first resetting unit, for, when the substantially uninterrupted predetermined first bit length group of the detected plurality of bits having at least the predetermined first bit length is substantially the substantially uninterrupted primary predetermined first bit length group of a detected plurality of bits having at least the predetermined first bit length, incrementing a first counter; a second counting unit, responsive to the second monitoring unit and to the at least first resetting unit, for, when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length, incrementing a second counter; a first delay unit, responsive to at least one of:

the first counting unit, the second counting unit, and a direct current indication detector; and first bit pattern determiner; for, when desired, substantially resetting a delay unit to a preselected delay period, and for, as preselected, initiating the predetermined delay period; a third monitoring unit, responsive to the first counting unit, the second counting unit, and the delay unit, for substantially determining whether, during a consecutive period of time uninterrupted by the predetermined delay period, a plurality of window-shifted substantially uninterrupted predetermined first bit length groups have a start to end bit length substantially equivalent to a second predetermined bit length, and for allowing recycling of digital data stream monitoring to the synchronous sequential symbol determiner when the plurality of substantially uninterrupted predetermined first bit length groups have a start to end bit length less than the second predetermined bit length during a consecutive period of time uninterrupted by the predetermined delay period; a first termination indicating unit, responsive to the third monitoring unit, for, when the plurality of window-shifted substantially uninterrupted predetermined first bit length groups have a start to end bit length substantially equivalent to the second predetermined bit length during a consecutive period of time uninterrupted by the predetermined delay period, indicating termination of the received multi-level digital signal data stream, and for allowing recycling of digital data stream monitoring to the synchronous sequential symbol determiner; a fourth monitoring unit, responsive to the first bit pattern determiner, for, when the substantially uninterrupted primary predetermined first bit length group of the detected plurality of bits having at least the predetermined first bit length has a bit pattern that does not substantially correspond to the first predetermined bit pattern of the multi-level digital signal data stream, determining whether the predetermined delay period has substantially elapsed; and a first resetting unit, responsive to the fourth monitoring unit and to the at least first delay determiner, for, when the predetermined delay period has substantially elapsed, at least resetting the first counter to zero and the second counter to zero; and for allowing recycling of monitoring to the synchronous sequential symbol determiner.

BRIEF DESCRIPTION OF THE DRAWINGS

FIG. 2A, 2B, and 2C illustrate typical 6K reclocked limited data for 3 KHz end of message (EOM) signals for 120 Hz, 60 Hz, and 10 Hz (10 Hz on a different scale), respectively, Doppler shifts.

FIG. 3 is a block diagram of an embodiment of an example of a multi-level digital signal data stream termination detecting device in accordance with the present invention.

DETAILED DESCRIPTION OF A PREFERRED EMBODIMENT

Figure 1:
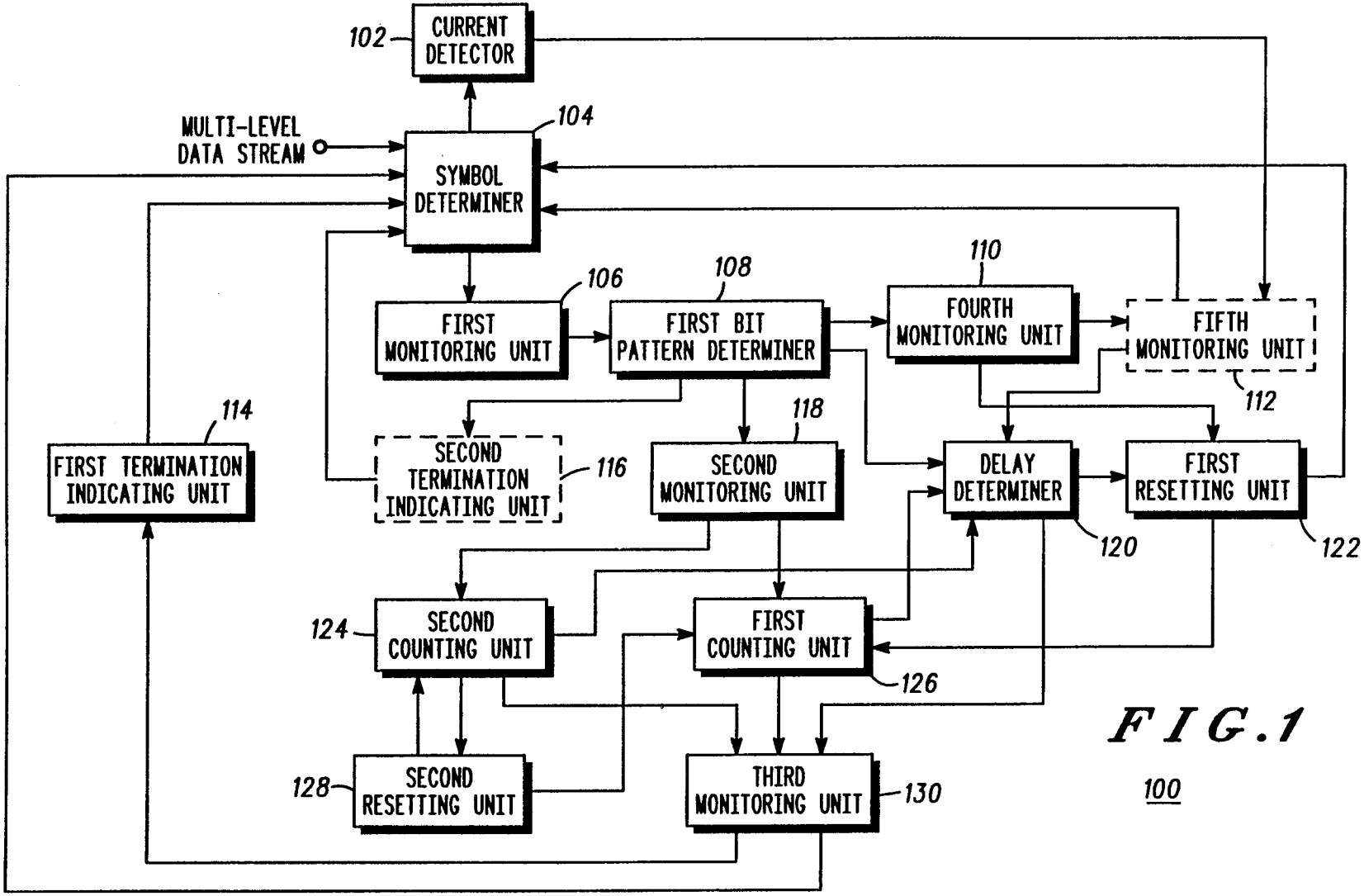
FIG. 1 is a block diagram of a multi-level digital signal data stream termination detecting device in accordance with the present invention.

FIG. 1, numeral 100, illustrates a general block diagram of a multi-level digital signal data stream termination detecting device in accordance with the present invention, arranged to provide multi-level digital data stream termination detection even in the presence of simulcast distortion substantially on a basis of detection of multiple relatively short detection patterns separated by a time less than a predetermined allowable time as well as termination detection on a basis of detection of certain predetermined substantially uninterrupted patterns. In a first embodiment, the device has at least a first synchronous sequential symbol determiner (SYMBOL DET) (104) that receives at least a first multi-level digital signal data stream, and that typically operates to provide reclocked limited data for a multi-level digital data stream signal. For example, a 3 KHz multi-level digital data stream signal is typically reclocked at 6K. The at least first synchronous sequential symbol determiner (104) determines at least a first plurality of detected bits in view of the at least first multi-level digital signal data stream. The at least first multi-level digital data stream is typically one of:

a binary-level, and a four-level, digital signal data stream.

For various Doppler shifts, an end of message (EOM) sequence is separated by similar-sized blocks of errors, as set forth in FIG. 2A–2C, numerals 200, 210, and 220 respectively. An EOM sequence typically substantially has a repetition of a basic pattern of: a block of 3 KHz, a block of 1's, a block of 3 KHz, and a block of 0's. FIG. 2A illustrates a typical 120 Hz Doppler shift pattern that substantially has a period T of 3.3 msec and a direct current (DC) band of 2 msec. FIG. 2B illustrates a typical 60 Hz Doppler shift pattern that substantially has a T of 16.7 msec and a DC band of 4 msec. FIG. 2C, drawn to a different scale than that of FIG. 2A and FIG. 2B, illustrates a typical 10 Hz Doppler shift pattern that substantially has a T of 100 msec and a DC band of 15–18 msec. For each pattern sequence, a Doppler shift frequency is 1/T, a repetition rate.

The at least first synchronous sequential symbol determiner (104) typically utilizes outermost levels of a multi-level eye pattern to obtain symbols, as is known in the art, to provide EOM pattern sequences that are limited versions of the symbols, hereafter referred to as bits, that are not to be confused with, for example, Q0 and Q1 bits obtained from demodulating each multi-level symbol. FIG. 1 further illustrates that at least a first monitoring unit (FIRST MON UNIT)(106) is responsive to the at least first synchronous sequential symbol determiner (104). The at least first monitoring unit (106) utilizes at least the first plurality of detected bits to determine at least a substantially uninterrupted primary predetermined first bit length group for each desired plurality of detected bits having at least a predetermined first bit length, and as desired, to determine at least a first window-shifted substantially uninterrupted second predetermined first bit length group for each desired plurality of consecutive detected bits having at least a predetermined first bit length. For example, a workable primary predetermined first bit length group is the limited version of the symbols, based on a sliding window, and having at least eight bits such that the bits are obtained utilizing two outermost eye pattern levels to provide a first predetermined bit pattern of one of: substantially alternating high and low and substantially alternating low and high. Window-shifting is utilized to obtain substantially consecutive predetermined bit length groups by setting a sliding window of a desired predetermined bit length, obtaining a substantially uninterrupted first predetermined desired bit length group, sliding the selected sliding window substantially one bit length, obtaining a substantially uninterrupted second predetermined desired bit length group, and continuing in said fashion until a desired number of substantially uninterrupted desired predetermined bit length groups are obtained.

FIG. 1 further illustrates that at least a first bit pattern determiner (FIRST BIT PATTERN DET)(108) is responsive to the at least first monitoring unit (106). The at least first bit pattern determiner (108) determines at least whether or not each substantially uninterrupted predetermined first bit length group of the plurality of bits having at least the predetermined first bit length has a bit pattern that substantially corresponds to a first predetermined bit pattern of the multi-level digital signal data stream, typically as set forth more specifically above.

FIG. 1 also illustrates that, where desired, and where the at least first bit pattern determiner (108) further determines that the at least first plurality of detected bits in view of the at least first multi-level digital signal data stream has substantially a predetermined second bit length that is limited, based on a sliding window, and the bits are obtained utilizing two outermost eye pattern levels to provide one of:

substantially alternating high and low and substantially alternating low and high, a second termination indicating unit (SEC TERMIN IND UNIT)(116), responsive to the at least first bit pattern determiner (108), may be utilized for indicating termination of the received multi-level digital signal data stream, and for allowing recycling of digital data stream monitoring to the synchronous sequential symbol determiner. A thirty-two bit length is substantially a workable predetermined second bit length.

FIG. 1 also illustrates that at least a second monitoring unit (SEC MON UNIT)(118) is responsive to the at least first bit pattern determiner (108). The at least second monitoring unit (118) determines substantially whether each substantially uninterrupted predetermined first bit length group of the detected plurality of bits having at least the predetermined first bit length and a bit pattern substantially corresponding to the first predetermined bit pattern of the multi-level digital signal data stream is one of:

the substantially uninterrupted primary predetermined first bit length group; and the window-shifted substantially uninterrupted at least second predetermined first bit length group.

FIG. 1 further illustrates that at least a first counting unit (FIRST COUNTING UNIT)(126) is responsive to the second monitoring unit and to at least a first resetting unit (FIRST RESET UNIT)(122), wherein, when the substantially uninterrupted predetermined first bit length group of the detected plurality of bits having at least the predetermined first bit length is substantially the substantially uninterrupted primary predetermined first bit length group of a detected plurality of bits having at least the predetermined first bit length, a first counter is incremented. The at least first resetting unit (122), illustrated in FIG. 1 is substantially responsive to a fourth monitoring unit (FOURTH MON UNIT)(110) and to at least a first delay determiner (DELAY DET)(120), for, when a predetermined delay period has substantially elapsed, at least resetting the first counter to zero and a second counter to zero, and for allowing recycling of monitoring to the synchronous sequential symbol determiner (104).

At least a first delay determiner (120), responsive to at least one of: the first counting unit (126), the second counting unit (124), a direct current indication detector (DC DET)(102), and the at least first bit pattern determiner (108); when desired, substantially resets a delay unit to a preselected delay period, and as preselected, initiates the predetermined delay period. The direct current indication detector (102) is typically substantially a selected logic device. The delay unit is typically inhibited throughout detection of direct current upon direct current indication being detected by the direct current indication detector (102). For example, the delay determiner (120) typically, where Doppler shifts are higher than substantially 30 Hz, resets the first resetting unit (122) when substantially 5.3 msec has passed without reception of the first predetermined bit pattern of the multi-level digital signal data stream.

FIG. 1 further illustrates that at least a second counting unit (SEC COUNTING UNIT)(124) is responsive to the second monitoring unit (118) and to the at least first resetting unit (122), where the second counting unit (124), wherein, when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length, the second counter is incremented. When the second counting unit (124) substantially obtains a predetermined count of bits, a second resetting unit (SEC RESET UNIT)(128), responsive to the at least second counting unit (124), resets the second counter to zero and increments the first counter. A typical workable predetermined count of bits is eight bits. Thus, the first counting unit (126) functions at least to count detection of up to a predetermined number of first predetermined bit patterns, typically nine patterns, and then to reset. The second counting unit (124) functions at least to quantize predetermined bit pattern bits received up to a predetermined number of bits, typically eight, and then to reset.

FIG. 1 also illustrates that at least a third monitoring unit (THIRD MON UNIT)(130) is responsive to the at least first counting unit (126), the at least second counting unit (124), and the delay determiner (120), and substantially determines whether, during a consecutive period of time uninterrupted by the predetermined delay period, a plurality of window-shifted substantially uninterrupted predetermined first bit length groups have a start to end bit length substantially equivalent to a second predetermined bit length, and allows recycling of digital data stream monitoring to the synchronous sequential symbol determiner when the plurality of substantially uninterrupted predetermined first bit length groups have a start to end bit length less than the second predetermined bit length during a consecutive period of time uninterrupted by the predetermined delay period. A start to end bit length of a plurality of window-shifted substantially uninterrupted predetermined first bit length groups is substantially determined by beginning counting a first bit of a first substantially uninterrupted predetermined first bit length group and continuing to count bits through and including a last bit of a last selected substantially uninterrupted predetermined first bit length group. A workable second predetermined bit length is substantially a seventy-two bit length.

FIG. 1 further illustrates that at least a first termination indicating unit (FIRST TERMIN UNIT)(114) is responsive to the at least third monitoring unit (130), such that, when the plurality of window-shifted substantially uninterrupted predetermined first bit length groups have a start to end bit length substantially equivalent to the second predetermined bit length during a consecutive period of time uninterrupted by the predetermined delay period, the at least first termination indicating unit (114) indicates termination of the received multi-level digital signal data stream, and allows recycling of digital data stream monitoring to the synchronous sequential symbol determiner (104).

In FIG. 1 the at least fourth monitoring unit (FOURTH MON UNIT)(110) is shown to be responsive to the at least first bit pattern determiner (108), and is utilized to, when the substantially uninterrupted primary predetermined first bit length group of the detected plurality of bits having at least the predetermined first bit length has a bit pattern that does not substantially correspond to the first predetermined bit pattern of the multi-level digital signal data stream, determine whether the predetermined delay period has substantially elapsed. The at least first resetting unit (122) is illustrated to be substantially responsive to the at least fourth monitoring unit (110), and the at least first delay determiner (120), such that, when the predetermined delay period has substantially elapsed, the at least first resetting unit (122) at least resets the first counter to zero and the second counter to zero, and allows recycling of monitoring to the synchronous sequential symbol determiner (104).

Where desired, as set forth in FIG. 1, a fifth monitoring unit (FIFTH MON UNIT) (112) is utilized, responsive to the at least fourth monitoring unit (110) and to the direct current indication detector (102), to, when the predetermined delay period has not substantially elapsed and a no direct current indication is detected, preselectably decrement the predetermined delay period and to allow recycling of digital data stream monitoring to the synchronous sequential symbol determiner (104); and when the predetermined delay period has not substantially elapsed and a direct current indication is detected, to allow recycling of digital data stream monitoring to the synchronous sequential symbol determiner (104).

FIG. 3, numeral 300, sets forth a block diagram of an embodiment of an example of a multi-level digital signal data stream termination detecting device in accordance with the present invention. A limited discriminator (304), substantially a synchronous sequential symbol determiner, is operably connected to an at least first monitoring unit (306), that is operably connected to an at least first bit pattern determiner (308) to determine, substantially as set forth above, at least whether or not each substantially uninterrupted predetermined first bit length group of the plurality of bits having at least the predetermined first bit length has a bit pattern that substantially corresponds to a first predetermined bit pattern of the multi-level digital signal data stream. A second monitoring unit (318) is substantially comprised of a first logic device (309), typically an AND gate, coupled to a pulse steering logic device (313), that is in turn coupled to a second logic device (311), typically an OR gate, the pulse steering logic device (313) being further coupled to a second counting unit (324), in one embodiment, typically a quantization retention counting device that counts to an optimum value of eight. The pulse steering logic device (313) is responsive to the first logic device (309) and to the at least first bit pattern determiner (308). The first logic device (309) is responsive to the at least first bit pattern determiner (308) receives a pulse at a rate of one pulse per symbol. A third logic device (315), typically an AND gate, and a direct current detector (317) substantially comprise a direct current indication detector (302), that operates as described above. The third logic device (315) is responsive to the direct current indicator (317) and receives a pulse at a rate of one pulse per symbol. A timeout timer (320), substantially operating as a delay determiner described above, is responsive to the at least first bit pattern determiner (308) and to the direct current indicator (317). A fourth logic device (328), typically an OR device, functions as a second resetting unit as described above, and is operably coupled to an at least first counting unit (326), the at least second counting unit (324), the second logic device (311), and the timeout timer (320). The at least first counting unit (326), in one embodiment, counts to nine, reflecting seventy-two error-free EOM bits having occurred in groups of eight or more, without a timeout.

If desired, a second termination indicating unit (316), responsive to the at least first bit pattern determiner (308) and to the first counting unit (326), is provided, wherein, when the at least first bit pattern determining means further determines that the at least first plurality of detected bits in view of the at least first multi-level digital signal data stream has at least a predetermined second bit length, typically a thirty-two bit length, that is limited, based on a sliding window, and the bits are obtained utilizing two outermost eye pattern levels to provide one of: substantially alternating high and low and substantially alternating low and high, the second termination indicating unit (316) is utilized to indicate termination of the received multi-level digital signal data stream, and to allow recycling of digital data stream monitoring to the synchronous sequential symbol determining means.

A fifth logic device (332), where desired, responsive to the first counting unit (326) and to the second termination indicating unit (116) is illustrated, wherein the fifth logic device, typically an OR gate, outputs EOM termination detection.

Figure 4:
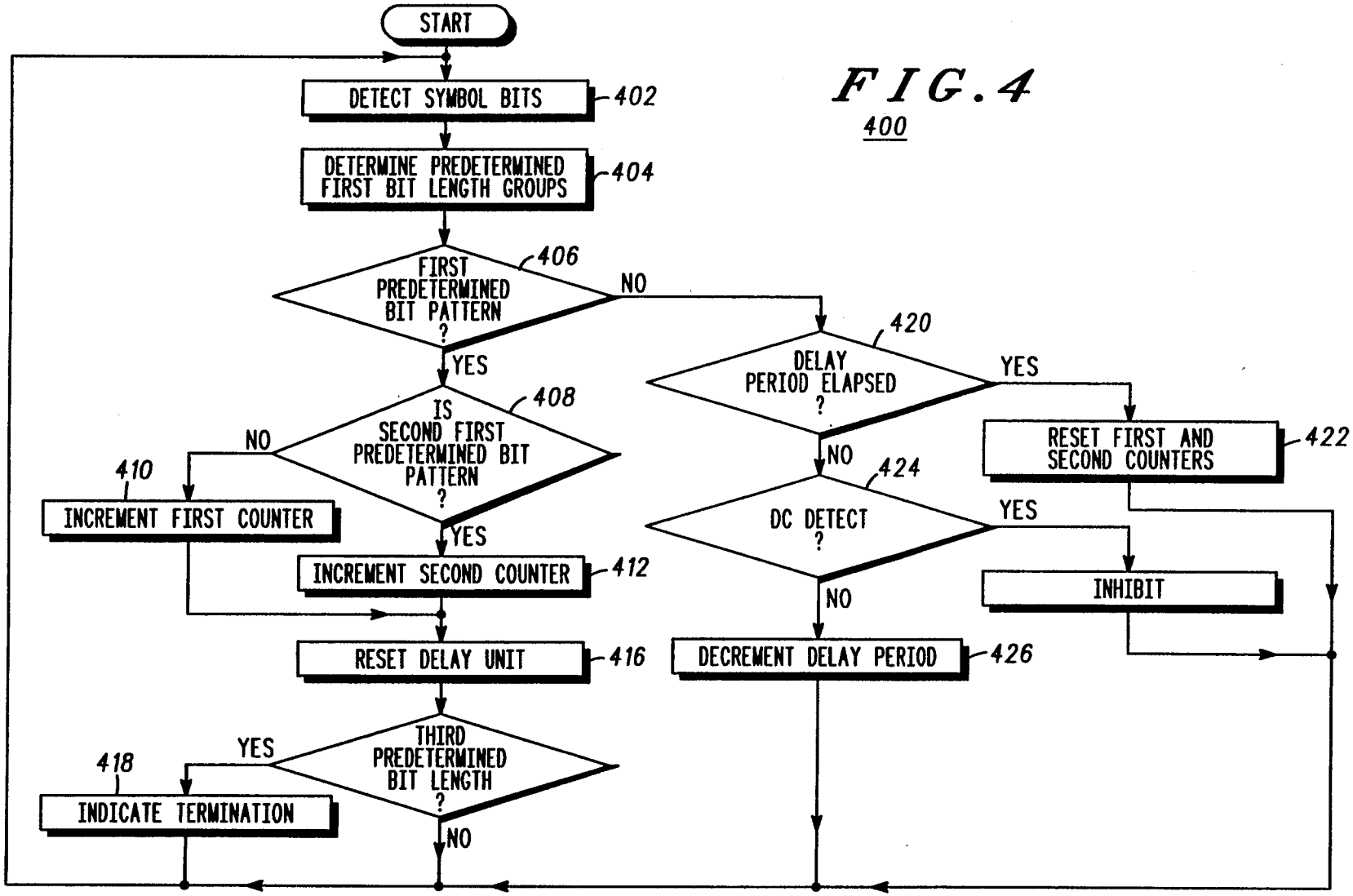
FIG. 4 is a flowchart illustrating steps executed to detect termination of a multi-level digital signal data stream substantially in accordance with the method of the present invention.

FIG. 4, numeral 400, is a flowchart illustrating steps executed to detect termination of a multi-level digital signal data stream substantially in accordance with the method of the present invention. The method of the present invention, for substantially detecting termination of at least a first received multi-level digital signal data stream, comprises at least the steps of: utilizing at least a first synchronous sequential symbol determiner to determine at least a first plurality of detected bits in view of the at least first multi-level digital signal data stream (402); utilizing at least the first plurality of detected bits to determine at least a substantially uninterrupted primary predetermined first bit length group for each desired plurality of detected bits having at least a predetermined first bit length, and as desired, to determine at least a first window-shifted substantially uninterrupted second predetermined first bit length group for each desired plurality of consecutive detected bits having at least a predetermined first bit length (404); utilizing at least each substantially uninterrupted predetermined first bit length group of the detected plurality of bits having at least the predetermined first bit length to determine at least whether or not the substantially uninterrupted primary last predetermined first bit length group of the plurality of bits having at least the predetermined first bit length has a bit pattern that substantially corresponds to a first predetermined bit pattern of the multi-level digital signal data stream (406); determining whether or not each predetermined first bit length group of the detected plurality of bits having at least the predetermined first bit length is substantially at least a second consecutive predetermined first bit length group of the detected plurality of bits having at least the predetermined first bit length when the substantially uninterrupted primary last predetermined first bit length group of the detected plurality of bits having at least the predetermined first bit length has a bit pattern that substantially corresponds to the first predetermined bit pattern of the multi-level digital signal data steam (408); incrementing a first counter when the substantially uninterrupted predetermined first bit length group of the detected plurality of bits having at least the predetermined first bit length is substantially the substantially uninterrupted primary predetermined first bit length group of a detected plurality of bits having at least the predetermined first bit length (410); incrementing a second counter when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length (412); resetting at least a first delay unit, when desired to a preselected delay period, and for, as preselected, initiating the predetermined delay period (416); determining substantially whether, during a consecutive period of time uninterrupted by the predetermined delay period, a plurality of window-shifted substantially uninterrupted predetermined first bit length groups have start to end bit length substantially equivalent to a second predetermined bit length, and allowing recycling of digital data stream monitoring to the synchronous sequential symbol determiner when the plurality of window-shifted substantially uninterrupted predetermined first bit length groups have start to end bit length less than the second predetermined bit length during a consecutive period of time uninterrupted by the predetermined delay period (416); indicating termination of the received multi-level digital signal data stream and allowing recycling of digital data stream monitoring to the synchronous sequential symbol determiner when the plurality of window-shifted substantially uninterrupted predetermined first bit length groups have a start to end bit length substantially equivalent to the second predetermined bit length during a consecutive period of time uninterrupted by the predetermined delay period (418); determining whether the predetermined delay period has elapsed when the substantially uninterrupted primary predetermined first bit length group of the detected plurality of bits having at least the predetermined first bit length has a bit pattern that does not substantially correspond to the first predetermined bit pattern of the multi-level digital signal data stream (420); and resetting the first counter to zero and the second counter to zero, and allowing recycling of monitoring to the synchronous sequential symbol determiner when the predetermined delay period has substantially elapsed (422).

The method may be selected to further include, as desired, at least one of the steps of: receiving an at least first received multi-level digital signal data stream that is a binary-level digital signal data stream; receiving an at least first received multi-level digital signal data stream that is a four-level digital signal data stream; resetting the second counter to zero and incrementing the first counter when the second counter substantially obtains a predetermined count of bits; having the first predetermined bit pattern of the multi-level digital signal data stream be limited, based on a sliding window, at least eight bits, and the bits are obtained utilizing two outermost eye pattern levels to provide one of: substantially alternating high and low and substantially alternating low and high; where the at least first bit pattern determiner further determines that the at least first plurality of detected bits in view of the at least first multi-level digital signal data stream has substantially a predetermined second bit length that is limited, based on a sliding window, and the bits are obtained utilizing two outermost eye pattern levels to provide one of: substantially alternating high and low and substantially alternating low and high, indicating termination of the received multi-level digital signal data stream, and allowing recycling of digital data stream monitoring to the synchronous sequential symbol determiner; preselectably decrementing the predetermined delay period and allowing recycling of digital data stream monitoring to the synchronous sequential symbol determiner when the predetermined delay period has not substantially elapsed (420) and a no direct current indication is detected (424); and inhibiting the delay unit throughout direct current indication detection, then allowing recycling of digital data stream monitoring to the synchronous sequential symbol determiner when the predetermined delay period has not substantially elapsed and a direct current indication is detected (426). It is clear that resetting the delay unit may be alternatively implemented, where desired, immediately following determining whether or not each predetermined first bit length group of the detected plurality of bits having at least the predetermined first bit length is substantially at least a second consecutive predetermined first bit length group of the detected plurality of bits having at least the predetermined first bit length when the substantially uninterrupted primary last predetermined first bit length group of the detected plurality of bits having at least the predetermined first bit length has a bit pattern that substantially corresponds to the first predetermined bit pattern of the multi-level digital signal data steam (408).

The method of the present invention may be further understood be reference to the more detailed description set forth above for the device of the present invention.

The present invention provides for decreasing detect times for low Doppler shift cases by inhibiting the delay unit when direct current indication is detected. When a false EOM is indicated by a limited random digital data stream, a delay determiner extends a delay unit time only slightly, thereby minimizing false EOM detection while also minimizing EOM detect times. The present invention provides for detection of termination of a multi-level digital signal data stream utilizing multiple relatively short pattern sequences that have certain intervening allowable times such that the termination may be made even in the presence of simulcast distortion.

I claim:

1. A device for substantially detecting termination of at least a first received multi-level digital signal data stream, having at least a first resetting means and at least a direct current indication detector, comprising at least:

A) first synchronous sequential symbol determining means, responsive to the at least received first multi-level digital signal data stream, for determining at least a first plurality of detected bits in view of the at least first multi-level digital signal data stream;

B) first monitoring means, responsive to the synchronous sequential symbol determining means, for utilizing at least the first plurality of detected bits to determine at least a substantially uninterrupted primary predetermined first bit length group for each desired plurality of detected bits having at least a predetermined first bit length, and to determine at least a first window-shifted substantially uninterrupted second predetermined first bit length group for each desired plurality of consecutive detected bits having at least a predetermined first bit length;

C) first bit pattern determining means, responsive to the first monitoring means, for determining at least whether or not each substantially uninterrupted predetermined first bit length group of the plurality of bits having at least the predetermined first bit length has a bit pattern that substantially corresponds to a first predetermined bit pattern of the multi-level digital signal data stream;

D) second monitoring means, responsive to the at least first bit pattern determining means, for determining whether each substantially uninterrupted predetermined first bit length group of the detected plurality of bits having at least the predetermined first bit length and a bit pattern substantially corresponding to the first predetermined bit pattern of the multi-level digital signal data stream is one of:

the substantially uninterrupted primary predetermined first bit length group; and the window-shifted substantially uninterrupted at least second predetermined first bit length group;

E) first counting means, responsive to the second monitoring means and to at least the first resetting means and the second resetting means, for, when the substantially uninterrupted predetermined first bit length group of the detected plurality of bits having at least the predetermined first bit length is substantially the substantially uninterrupted primary predetermined first bit length group of a detected plurality of bits having at least the predetermined first bit length, incrementing a first counter;

F) second counting means, responsive to the second monitoring means and to at least the second resetting means, for, when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length, incrementing a second counter;

G) first delay means, responsive to at least one of:

the first counting means, the second counting means, and the direct current indication detector (which is responsive to the first synchronous sequential symbol determining means); and first bit pattern determining means;

for substantially resetting a delay to a preselected delay period, and for, as preselected, outputting the predetermined delay period;

H) third monitoring means, responsive to the first counting means, the second counting means, and the delay means, for substantially determining whether, during a consecutive period of time uninterrupted by the predetermined delay period, a plurality of window-shifted substantially uninterrupted predetermined first bit length groups have a start to end bit length substantially equivalent to a second predetermined bit length, and for allowing recycling of digital data stream monitoring to the synchronous sequential symbol determining means when the plurality of substantially uninterrupted predetermined first bit length groups have a start to end bit length less than the second predetermined bit length during a consecutive period of time uninterrupted by the predetermined delay period;

I) first termination indicating means, responsive to the third monitoring means, for, when the plurality of window-shifted substantially uninterrupted predetermined first bit length groups have a start to end bit length substantially equivalent to the second predetermined bit length during a consecutive period of time uninterrupted by the predetermined delay period, indicating termination of the received multi-level digital signal data stream, and for allowing recycling of digital data stream monitoring to the synchronous sequential symbol determining means;

J) fourth monitoring means, responsive to the at least first bit pattern determining means, for, when the substantially uninterrupted primary predetermined first bit length group of the detected plurality of bits having at least the predetermined first bit length has a bit pattern that does not substantially correspond to the first predetermined bit pattern of the multi-level digital signal data stream, determining whether the predetermined delay period has substantially elapsed; and K) the first resetting means, being responsive to the fourth monitoring means and to the at least first delay means, for, when the predetermined delay period has substantially elapsed, at least resetting the first counter to zero and the second counter to zero, and for allowing recycling of monitoring to the synchronous sequential symbol determining means.

2. The device of claim 1, wherein the at least first received multi-level digital signal data stream is a digital signal data stream for a binary-level baseband waveform.

3. The device of claim 1, wherein the at least first received multi-level digital signal data stream is a digital signal data stream for a four-level baseband waveform.

4. The device of claim 1, further including second resetting means, responsive to the second counting means, for, when the second counting means substantially obtains a predetermined count of bits, resetting the second counter to zero.

5. The device of claim 1, wherein the first predetermined bit pattern of the multi-level digital signal data stream is limited, based on a sliding window, is at least eight bits, and the bits are obtained utilizing two outermost eye pattern levels to provide one of: substantially alternating high and low and substantially alternating low and high.

6. The device of claim 1, further including, where the at least first bit pattern determining means further determines that the at least first plurality of detected bits in view of the at least first multi-level digital signal data stream has substantially a predetermined second bit length that is limited, based on a sliding window, and the bits are obtained utilizing two outermost eye pattern levels to provide one of: substantially alternating high and low and substantially alternating low and high, second termination indicating means, responsive to the first bit pattern determining means, for indicating termination of the received multi-level digital signal data stream, and allowing recycling of digital data stream monitoring to the synchronous sequential symbol determining means.

7. The device of claim 1, further including at least fifth monitoring means, responsive to the fourth monitoring means and to the direct current indication detector, for:

when the predetermined delay period has not substantially elapsed and a no direct current indication is detected, proselectably decrementing the predetermined delay period and for allowing recycling of digital data stream monitoring to the synchronous sequential symbol determining means; and when the predetermined delay period has not substantially elapsed and a direct current indication is detected, inhibiting the delay unit substantially throughout direct current indication detection, then allowing recycling of digital data stream monitoring to the synchronous sequential symbol determining means.

8. A device for substantially detecting termination of at least a first received multi-level digital signal data stream, having at least a first resetting means and at least a direct current indication detector, comprising at least:

A) first synchronous sequential symbol determining means, responsive to the at least received first multi-level digital signal data stream, for determining at least a first plurality of detected bits in view of the at least first multi-level digital signal data stream;

B) first monitoring means, responsive to the synchronous sequential symbol determining means, for utilizing at least the first plurality of detected bits to determine at least a substantially uninterrupted primary eight bit length group for each desired plurality of detected bits having at least an eight bit length, and to determine at least a first window-shifted substantially uninterrupted second eight bit length group for each desired plurality of consecutive detected bits having at least an eight bit length;

C) first bit pattern determining means, responsive to the first monitoring means, for determining at least whether or not each substantially uninterrupted eight bit length group of the plurality of bits has a bit pattern that substantially corresponds to a first predetermined bit pattern of the multi-level digital signal data stream;

D) second monitoring means, responsive to the first bit pattern determining means, for determining whether each substantially uninterrupted eight bit length group of the detected plurality of bits having at least the eight bit length and a bit pattern substantially corresponding to the first predetermined bit pattern of the multi-level digital signal data stream is one of:

the substantially uninterrupted primary eight bit length group; and the window-shifted substantially uninterrupted at least second eight bit length group;

E) first counting means, responsive to the second monitoring means and to at least the first resetting means and the second resetting means, for, when the substantially uninterrupted eight bit length group of the detected plurality of bits having at least the eight bit length is substantially the substantially uninterrupted primary eight bit length group of a detected plurality of bits having at least the eight bit length, incrementing a first counter;

F) second counting means, responsive to the second monitoring means and to at least the second resetting means, for, when the substantially uninterrupted eight bit length group of the detected plurality of bits having at least the eight bit length is substantially the window-shifted substantially uninterrupted at least second eight bit length group of a plurality of consecutive detected bits having at least the eight bit length, incrementing a second counter;

G) first delay means, responsive to at least one of:

the first counting means, the second counting means, and the direct current indication detector (which is responsive to the first synchronous sequential symbol determining means); and first bit pattern determining means;

for substantially resetting a delay to a preselected delay period, and for, as preselected, outputting the predetermined delay period;

H) third monitoring means, responsive to the first counting means, the second counting means, and the delay means, for substantially determining whether, during a consecutive period of time uninterrupted by the predetermined delay period, a plurality of substantially uninterrupted window-shifted eight bit length groups have a start to end bit length substantially equivalent to a second predetermined bit length, and for allowing recycling of digital data stream monitoring to the synchronous sequential symbol determining means when the plurality of substantially uninterrupted predetermined first bit length groups have start to end bit length less than the second predetermined bit length during a consecutive period of time uninterrupted by the predetermined delay period;

I) first termination indicating means, responsive to the third monitoring means, for, when the plurality of substantially uninterrupted window-shifted eight bit length groups have a start to end bit length substantially equivalent to the second predetermined bit length during a consecutive period of time uninterrupted by the predetermined delay period, indicating termination of the received multi-level digital signal data stream, and for allowing recycling of digital data stream monitoring to the synchronous sequential symbol determining means;

J) fourth monitoring means, responsive to the at least first bit pattern determining means, for, when the substantially uninterrupted primary eight bit length group of the detected plurality of bits having at least the eight bit length has a bit pattern that does not substantially correspond to the first predetermined bit pattern of the multi-level digital signal data stream, determining whether the predetermined delay period has substantially elapsed; and K) the first resetting means, being responsive to the fourth monitoring means and to the at least first delay means, for, when the predetermined delay period has substantially elapsed, at least resetting the first counter to zero and the second counter to zero, and for allowing recycling of monitoring to the synchronous sequential symbol determining means.

9. The device of claim 8, wherein the at least first received multi-level digital signal data stream is a digital signal data stream for a binary-level baseband waveform.

10. The device of claim 8, wherein the at least first received multi-level digital signal data stream is a digital signal data stream for a four-level baseband waveform.

11. The device of claim 8, further including second resetting means, responsive to the second counting means, for, when the second counting means substantially obtains a count of eight bits, resetting the second counter to zero.

12. The device of claim 8, wherein the first predetermined bit pattern of the multi-level digital signal data stream is limited, based on a sliding window, is at least eight bits, and the bits are obtained utilizing two outermost eye pattern levels to provide one of: substantially alternating high and low and substantially alternating low and high.

13. The device of claim 8, further including, where the at least first bit pattern determining means further determines that the at least first plurality of detected bits in view of the at least first multi-level digital signal data stream has at least a thirty-two bit length that is limited, based on a sliding window, and the bits are obtained utilizing two outermost eye pattern levels to provide one of: substantially alternating high and low and substantially alternating low and high, second termination indicating means, responsive to the first bit pattern determining means, for indicating termination of the received multi-level digital signal data stream, and allowing recycling of digital data stream monitoring to the synchronous sequential symbol determining means.

14. The device of claim 8, further including at least fifth monitoring means, responsive to the fourth monitoring means and to the direct current indication detector, for:

when the predetermined delay period has not substantially elapsed and a no direct current indication is detected, preselectably decrementing the predetermined delay period and for allowing recycling of digital data stream monitoring to the synchronous sequential symbol determining means; and when the predetermined delay period has not substantially elapsed and a direct current indication is detected, inhibiting the delay unit substantially throughout direct current indication detection, then allowing recycling of digital data stream monitoring to the synchronous sequential symbol determining means.

15. A device in a radio for substantially detecting termination of at least a first received multi-level digital signal data stream, having at least a first resetting means and at least a direct current indication detector, comprising at least;

A) first synchronous sequential symbol determining means, responsive to the at least received first multi-level digital signal data stream, for determining at least a first plurality of detected bits in view of the at least first multi-level digital signal data stream;

B) first monitoring means, responsive to the synchronous sequential symbol determining means, for utilizing at least the first plurality of detected bits to determine at least a substantially uninterrupted primary predetermined first bit length group for each desired plurality of detected bits having at least a predetermined first bit length, and to determine at least a first window-shifted substantially uninterrupted second predetermined first bit length group for each desired plurality of consecutive detected bits having at least a predetermined first bit length;

C) first bit pattern determining means, responsive to the first monitoring means, for determining at least whether or not each substantially uninterrupted predetermined first bit length group of the plurality of bits having at least the predetermined first bit length has a bit pattern that substantially corresponds to a first predetermined bit pattern of the multi-level digital signal data stream;

D) second monitoring means, responsive to the first bit pattern determining means, for determining whether each substantially uninterrupted predetermined first bit length group of the detected plurality of bits having at least the predetermined first bit length and a bit pattern substantially corresponding to the first predetermined bit pattern of the multi-level digital signal data stream is one of:

the substantially uninterrupted primary predetermined first bit length group; and the window-shifted substantially uninterrupted at least second predetermined first bit length group;

E) first counting means, responsive to the second monitoring means and to at least the first resetting means and the second resetting means, for, when the substantially uninterrupted predetermined first bit length group of the detected plurality of bits having at least the predetermined first bit length is substantially the substantially uninterrupted primary predetermined first bit length group of a detected plurality of bits having at least the predetermined first bit length, incrementing a first counter;

F) second counting means, responsive to the second monitoring means and to at least the second resetting means, for, when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length, incrementing a second counter;

G) first delay means, responsive to at least one of:

the first counting means, the second counting means, and the direct current indication detector (which is responsive to the first synchronous sequential symbol determining means); and first bit pattern determining means;

for substantially resetting a delay to a preselected delay period, and for, as preselected, outputting the predetermined delay period;

H) third monitoring means, responsive to the first counting means, the second counting means, and the delay means, for substantially determining whether, during a consecutive period of time uninterrupted by the predetermined delay period, a plurality of window-shifted substantially uninterrupted predetermined first bit length groups have a start to end bit length substantially equivalent to a second predetermined bit length, and for allowing recycling of digital data stream monitoring to the synchronous sequential symbol determining means when the plurality of substantially uninterrupted predetermined first bit length groups have start to end bit length less than the second predetermined bit length during a consecutive period of time uninterrupted by the predetermined delay period;

I) first termination indicating means, responsive to the third monitoring means, for, when the plurality of window-shifted substantially uninterrupted predetermined first bit length groups have start to end bit length substantially equivalent to the second predetermined bit length during a consecutive period of time uninterrupted by the predetermined delay period, indicating termination of the received multi-level digital signal data stream, and for allowing recycling of digital data stream monitoring to the synchronous sequential symbol determining means;

J) fourth monitoring means, responsive to the at least first bit pattern determining means, for, when the substantially uninterrupted primary predetermined first bit length group of the detected plurality of bits having at least the predetermined first bit length has a bit pattern that does not substantially correspond to the first predetermined bit pattern of the multi-level digital signal data stream, determining whether the predetermined delay period has substantially elapsed; and K) the first resetting means, being responsive to the fourth monitoring means and to the at least first delay means, for, when the predetermined delay period has substantially elapsed, at least resetting the first counter to zero and the second counter to zero, and for allowing recycling of monitoring to the synchronous sequential symbol determining means.

16. The device of claim 15, wherein the at least first received multi-level digital signal data stream is a digital signal data stream for a binary-level baseband waveform.

17. The device of claim 15, wherein the at least first received multi-level digital signal data stream is a digital signal data stream for a four-level baseband waveform.

18. The device of claim 15, further including second resetting means, responsive to the second counting means, for, when the second counting means substantially obtains a predetermined count of bits, resetting the second counter to zero.

19. The device of claim 15, wherein the first predetermined bit pattern of the multi-level digital signal data stream is limited, based on a sliding window, is at least eight bits, and the bits are obtained utilizing two outermost eye pattern levels to provide one of: substantially alternating high and low and substantially alternating low and high.

20. The device of claim 15, further including, where the at least first bit pattern determining means further determines that the at least first plurality of detected bits in view of the at least first multi-level digital signal data stream has substantially a predetermined second bit length that is limited, based on a sliding window, and the bits are obtained utilizing two outermost eye pattern levels to provide one of: substantially alternating high and low and substantially alternating low and high, second termination indicating means, responsive to the first bit pattern determining means, for indicating termination of the received multi-level digital signal data stream, and allowing recycling of digital data stream monitoring to the synchronous sequential symbol determining means.

21. The device of claim 15, further including at least fifth monitoring means, responsive to the fourth monitoring means and to the direct current indication detector, for:

when the predetermined delay period has not substantially elapsed and a no direct current indication is detected, preselectably decrementing the predetermined delay period and for allowing recycling of digital data stream monitoring to the synchronous sequential symbol determining means; and when the predetermined delay period has not substantially elapsed and a direct current indication is detected, inhibiting the delay unit substantially throughout direct current indication detection, then allowing recycling of digital data stream monitoring to the synchronous sequential symbol determining means.

22. A method for substantially detecting termination of at least a first received multi-level digital signal data stream, comprising at least the steps of:

A) utilizing at least a first synchronous sequential symbol determiner to determine at least a first plurality of detected bits in view of the at least first multi-level digital signal data stream;

B) utilizing at least the first plurality of detected bits to determine at least a substantially uninterrupted primary predetermined first bit length group for each desired plurality of detected bits having at least a predetermined first bit length, and to determine at least a first window-shifted substantially uninterrupted second predetermined first bit length group for each desired plurality of consecutive detected bits having at least a predetermined first bit length;

C) utilizing at least each substantially uninterrupted predetermined first bit length group of the detected plurality of bits having at least the predetermined first bit length to determine at least whether or not the substantially uninterrupted primary last predetermined first bit length group of the plurality of bits having at least the predetermined first bit length has a bit pattern that substantially corresponds to a first predetermined bit pattern of the multi-level digital signal data stream;

D) determining whether or not each predetermined first bit length group of the detected plurality of bits having at least the predetermined first bit length is substantially at least a second consecutive predetermined first bit length group of the detected plurality of bits having at least the predetermined first bit length when the substantially uninterrupted primary last predetermined first bit length group of the detected plurality of bits having at least the predetermined first bit length has a bit pattern that substantially corresponds to the first predetermined bit pattern of the multi-level digital signal data stream;

E) incrementing a first counter when the substantially uninterrupted predetermined first bit length group of the detected plurality of bits having at least the predetermined first bit length is substantially the substantially uninterrupted primary predetermined first bit length group of a detected plurality of bits having at least the predetermined first bit length;

F) incrementing a second counter when the substantially uninterrupted predetermined first bit length group of the detected plurality of bits having at least the predetermined first bit length is substantially the window-shifted substantially uninterrupted at least second predetermined first bit length group of a plurality of consecutive detected bits having at least the predetermined first bit length;

G) resetting at least a first delay unit to a preselected delay period, and for, as preselected, initiating the predetermined delay period;

H) determining substantially whether, during a consecutive period of time uninterrupted by the predetermined delay period, a plurality of window-shifted substantially uninterrupted predetermined first bit length groups have start to end bit length substantially equivalent to a second predetermined bit length, and allowing recycling of digital data stream monitoring to the synchronous sequential symbol determiner when the plurality of window-shifted substantially uninterrupted predetermined first bit length groups have start to end bit length less than the second predetermined bit length during a consecutive period of time uninterrupted by the predetermined delay period;

I) indicating termination of the received multi-level digital signal data stream and allowing recycling of digital data stream monitoring to the synchronous sequential symbol determiner when the plurality of window-shifted substantially uninterrupted predetermined first bit length groups have a start to end bit length substantially equivalent to the second predetermined bit length during a consecutive period of time uninterrupted by the predetermined delay period;

J) determining whether the predetermined delay period has elapsed when the substantially uninterrupted primary predetermined first bit length group of the detected plurality of bits having at least the predetermined first bit length has a bit pattern that does not substantially correspond to the first predetermined bit pattern of the multi-level digital signal data stream;

K) resetting the first counter to zero and the second counter to zero, and allowing recycling of monitoring to the synchronous sequential symbol determiner when the predetermined delay period has substantially elapsed; and L) determining whether a direct current indication has been detected when the predetermined delay period has not substantially elapsed; and M) decrementing the delay unit a predetermined length of time and allowing recycling of digital data stream monitoring to the synchronous sequential symbol determiner when no direct current indication is detected.

23. The method of claim 22, wherein the at least first received multi-level digital signal data stream is a digital signal data stream for a binary-level baseband waveform.

24. The method of claim 22, wherein the at least first received multi-level digital signal data stream is a digital signal data stream for a four-level baseband waveform.

25. The method of claim 22, further including the steps of resetting the second counter to zero and incrementing the first counter when the second counter substantially obtains a predetermined count of bits.

26. The method of claim 22, wherein the first predetermined bit pattern of the multi-level digital signal data stream is limited, based on a sliding window, at least eight bits, and the bits are obtained utilizing two outermost eye pattern levels to provide one of: substantially alternating high and low and substantially alternating low and high.

27. The method of claim 22, further including the step of:

where the at least first bit pattern determiner further determines that the at least first plurality of detected bits in view of the at least first multi-level digital signal data stream has substantially a predetermined second bit length that is limited, based on a sliding window, and the bits are obtained utilizing two outermost eye pattern levels to provide one of: substantially alternating high and low and substantially alternating low and high, indicating termination of the received multi-level digital signal data stream, and allowing recycling of digital data stream monitoring to the synchronous sequential symbol determiner.

28. The method of claim 22, further including at least the steps of:

preselectably decrementing the predetermined delay period and allowing recycling of digital data stream monitoring to the synchronous sequential symbol determiner when the predetermined delay period has not substantially elapsed and a no direct current indication is detected; and allowing recycling of digital data stream monitoring to the synchronous sequential symbol determiner when the predetermined delay period has not substantially elapsed and a direct current indication is detected.

* * * * *